US011384548B2

(12) United States Patent
Baylor

(10) Patent No.: US 11,384,548 B2
(45) Date of Patent: Jul. 12, 2022

(54) SLEEVE FOR CONCRETE SLAB PENETRATION

(71) Applicant: DPR Construction, A General Partnership, Redwood City, CA (US)

(72) Inventor: Scott Baylor, Buda, TX (US)

(73) Assignee: DPR Construction, Redwood City, CA (US)

( * ) Notice: Subject to any disclaimer, the term of this patent is extended or adjusted under 35 U.S.C. 154(b) by 0 days.

(21) Appl. No.: 16/842,349

(22) Filed: Apr. 7, 2020

(65) Prior Publication Data

US 2020/0325695 A1 Oct. 15, 2020

Related U.S. Application Data

(60) Provisional application No. 62/833,592, filed on Apr. 12, 2019.

(51) Int. Cl.
*E04G 15/06* (2006.01)
*E04G 11/38* (2006.01)

(52) U.S. Cl.
CPC ..... *E04G 15/063* (2013.01); *E04G 11/38* (2013.01); *E04G 15/068* (2013.01)

(58) Field of Classification Search
CPC ..... E04G 15/00; E04G 15/04; E04G 15/063; E04G 15/068; E04G 15/061; E04G 15/06;
(Continued)

(56) References Cited

U.S. PATENT DOCUMENTS 2,684,518 A * 7/1954 Whitlock ..... E04G 15/00 249/52
3,346,230 A * 10/1967 Tolf, Jr. ..... E04G 15/063 249/177

(Continued)

FOREIGN PATENT DOCUMENTS

CH 670472 A5 * 6/1989 ..... E04B 2/8611
CN 106938403 A * 7/2017

(Continued)

OTHER PUBLICATIONS

Crete-Sleeve® Products, "Crete-Sleeve® Plastic Hole Forms are injection molded from durable high-density polyethylene (HDPE)", www.cretesleeve.com/products, known as early as Apr. 7, 2019, 5 pages.

*Primary Examiner* — Michael Safavi
(74) *Attorney, Agent, or Firm* — Brownstein Hyatt Farber Schreck, LLP

(57) ABSTRACT

A sleeve for forming a channel through a concrete slab is described herein. The sleeve includes a sleeve body with top and bottom ends extending along a longitudinal axis, wherein the top end is wider than the bottom end. The sleeve includes an attachment flange attached to the bottom end that extends laterally outward with respect to the longitudinal axis. The attachment flange may be secured to a concrete form. An alternative sleeve has an attachment mechanism protruding from the first end of the sleeve body for facilitating the attachment of the sleeve body to a concrete form. In some embodiments, the sleeve can also include a removal mechanism disposed at the second end of the sleeve body to facilitate removal of the sleeve body from the concrete slab. Various sleeve configurations are described, some of which are reusable and some of which are one-time use only.

16 Claims, 16 Drawing Sheets

(58) Field of Classification Search
CPC ..... E04G 15/065; B28B 7/28; B28B 7/285; B28B 7/306; B28B 7/348; B28B 7/303
See application file for complete search history.

(56) References Cited

U.S. PATENT DOCUMENTS

| | | | | | |
|---|---|---|---|---|---|
| 3,933,336 | A * | 1/1976 | Tolf, Jr. | E04G 15/04 | 249/177 |
| 4,077,599 | A * | 3/1978 | Oland | B28B 7/28 | 249/177 |
| 4,089,502 | A * | 5/1978 | Miller | B28B 7/28 | 249/175 |
| 4,515,271 | A * | 5/1985 | Auciello | B28B 7/303 | 206/519 |
| 4,706,927 | A * | 11/1987 | Lawall | E04G 15/063 | 249/13 |
| 5,431,366 | A * | 7/1995 | Matsumoto | B28B 7/348 | 249/13 |
| 8,024,900 | B2 * | 9/2011 | Cordis | F16L 5/04 | 52/220.8 |
| 9,945,115 | B2 * | 4/2018 | Lin | F16B 5/0275 | |
| 2016/0326738 | A1 * | 11/2016 | Lin | F16B 37/00 | |
| 2018/0002937 | A1 * | 1/2018 | Freeman | E04G 23/0203 | |
| 2018/0258653 | A1 * | 9/2018 | Gonzalez | E04B 5/48 | |

FOREIGN PATENT DOCUMENTS

| | | | | | |
|---|---|---|---|---|---|
| CN | 112031412 | A * | 12/2020 | | |
| DE | 1944894 | A1 * | 3/1971 | B28B 7/342 | |
| DE | 19700280 | A1 * | 7/1997 | E04G 15/04 | |
| DE | 102004044909 | A1 * | 3/2006 | B05B 17/08 | |
| DE | 102009016693 | A1 * | 10/2010 | E04C 5/122 | |
| DE | 202021100547 | U1 * | 5/2021 | F16B 13/124 | |
| EP | 0071895 | A2 * | 2/1983 | B28B 7/348 | |
| FR | 1275072 | A * | 11/1961 | E04G 15/066 | |
| FR | 2570418 | A1 * | 3/1986 | E04G 15/02 | |
| FR | 2804147 | A1 * | 7/2001 | E04G 15/061 | |
| FR | 2903440 | A1 * | 1/2008 | E04G 15/063 | |
| GB | 757553 | A * | 9/1956 | B28B 7/303 | |
| KR | 100743616 | B1 * | 8/2007 | | |
| KR | 20100122781 | A * | 11/2010 | | |
| KR | 20110043711 | A * | 4/2011 | F16L 5/04 | |
| KR | 200455770 | Y1 * | 9/2011 | | |
| KR | 101125970 | B1 * | 3/2012 | | |
| KR | 20120033525 | A * | 4/2012 | | |
| KR | 101585603 | B1 * | 1/2016 | | |
| KR | 101784212 | B1 * | 10/2017 | | |
| KR | 102279248 | B1 * | 7/2021 | | |
| WO | WO-9516140 | A1 * | 6/1995 | E04G 15/061 | |
| WO | WO-2010014316 | A2 * | 2/2010 | E04G 15/063 | |

* cited by examiner

SLEEVE FOR CONCRETE SLAB PENETRATION

CROSS-REFERENCES TO RELATED APPLICATIONS

This application claims the benefit of priority to U.S. Provisional Patent Application No. 62/833,592, filed Apr. 12, 2019, entitled "SLEEVE FOR CONCRETE SLAB PENETRATION," the contents of which is hereby incorporated by reference in its entirety.

BACKGROUND OF THE INVENTION

The proper formation and alignment of concrete slabs is critical in today's high rise construction industry. While concrete slab formation techniques have enjoyed progressive improvement, room for improvement still exists. For example, it can be difficult to identify small variations in the alignment of concrete slabs distributed across multiple floors of a multi-floor building and these variations have the potential to impact the alignment of other structural components of the building. There is also room for improvement in the measuring of the alignment of concrete slabs distributed across multiple floors. For at least these reasons, apparatuses and methods for improving the formation of concrete slabs are desirable.

SUMMARY OF THE INVENTION

This disclosure describes various methods and apparatus to aid in the formation and alignment of concrete slabs. In particular, a sleeve for forming a tapered channel extending through a concrete slab is described.

Various sleeves are described for forming a channel through a concrete slab. In some embodiments, the sleeve may include a sleeve body having a top end and a bottom end extending along a longitudinal axis, wherein the top end has a first cross-sectional area perpendicular to the longitudinal axis and the bottom end has a second cross-sectional area perpendicular to the longitudinal axis. The first cross-sectional area of the top end may be greater than the second cross-sectional area of the bottom end. In some embodiments, the sleeve may include an attachment flange attached to the bottom end of the sleeve body. In some embodiments, the attachment flange may extend laterally outward from the bottom end with respect to the longitudinal axis, the attachment flange being configured to facilitate attachment of the sleeve body to a concrete form.

In some embodiments, the sleeve body is tapered between the top end and the bottom end, such that a cross-sectional area of the sleeve body perpendicular to the longitudinal axis incrementally decreases from the top end to the bottom end.

In some embodiments, the attachment flange extends along a plane perpendicular to the longitudinal axis. In some embodiments, the attachment flange has a cross-sectional area perpendicular to the longitudinal axis that is greater than a cross-sectional area of the sleeve body at the bottom end. In some embodiments, the cross-sectional area of the attachment flange is greater than the cross-sectional area of the sleeve body at the top end.

In some embodiments, the sleeve body has a cone-shaped geometry, and wherein the attachment flange has a circular geometry that extends radially outward from the bottom end with respect to the longitudinal axis. In some embodiments, cross-sections along the sleeve body perpendicular to the longitudinal axis are circular. Alternatively, the cross-sections may be elliptical, rectangular, triangular, or may be of any other suitable shape.

In some embodiments, the sleeve body is hollow, such that the sleeve body defines a channel, the longitudinal axis extending through the channel. In some embodiments, the sleeve body includes an optically transparent or translucent portion configured to permit an optical beam to pass therethrough. In some embodiments, the attachment flange includes one or more fastener openings, each configured to receive a screw, a nail, or a bolt for affixing the attachment flange to a wall of the concrete form.

In some embodiments, the sleeve body is formed from a hardened polymer material. In some embodiments, the sleeve body includes a high density polyethylene (HDPE) material.

The disclosure describes example methods for using sleeves for alignment. In some embodiments, concrete slabs of a building structure may be aligned using a sleeve. Methods in these embodiments may include positioning an optical beam source on a first floor of a building structure; causing the optical beam source to emit an optical beam toward a first location of a concrete form of a second floor; forming an opening in the concrete form of the second floor at the first location; and disposing a first sleeve at the first location. The first sleeve may include a sleeve body having a top end and a bottom end extending along a longitudinal axis, wherein the top end is wider than the bottom end. The first sleeve may further include an attachment flange attached to the bottom end of the sleeve body, wherein the attachment flange extends laterally outward from the bottom end with respect to the longitudinal axis, the attachment flange being configured to facilitate attachment of the sleeve body to a concrete form. The method may further include securing the first sleeve to the concrete form of the second floor at the first location; pouring a first concrete mixture into the concrete form; allowing the first concrete mixture to at least partially harden around the first sleeve; and removing the first sleeve so as to leave behind a first tapered channel in the first concrete mixture.

In some embodiments, the method may further include orienting the optical beam such that the optical beam is perpendicular to the first floor; and confirming that the optical beam travels through the first tapered channel such that the optical beam is perpendicular to the second floor.

In some embodiments, the method may further include causing the optical beam to travel through the first tapered channel toward a second location of a concrete form of a third floor; forming an opening in the concrete form of the third floor at the second location; and securing a second sleeve to the concrete form of the third floor at the second location. The method may also include removing the second sleeve so as to leave behind a second tapered channel; and confirming that the optical beam travels through the first tapered channel and the second tapered channel.

In some embodiments, the method may further include positioning, through the first tapered channel, a tapered plug dimensioned to fit at a bottom of the first tapered channel; and pouring a second concrete mixture into the first tapered channel.

In some embodiments, the optical beam source may be a laser. In some embodiments, securing the first sleeve includes inserting one or more screws into one or more fastener openings of the attachment flange. In some embodiments, removing the first sleeve includes breaking the sleeve body.

In some embodiments, a sleeve may include a sleeve body having a first end and a second end wider than the first end, and an attachment mechanism protruding from the first end of the sleeve body. The attachment mechanism may be configured to facilitate attachment of the sleeve body to a concrete form. In some embodiments, the sleeve may include a removal mechanism disposed at the second end of the sleeve body, the removal mechanism being configured to facilitate removal of the sleeve body from the concrete slab.

In some embodiments, the sleeve may have a cone-shaped geometry, a cylindrical geometry, a pyramidal geometry, a cuboidal geometry, or any other suitable geometry. In some embodiments, the sleeve body includes a base portion having a cylindrical geometry at the first end of the sleeve body, the base portion being integrally formed with a tapered portion having a conical frustum geometry. In some embodiments, the base portion has a height of between 0.5 and 1.0 inches.

In some embodiments, the sleeve body defines a channel, a longitudinal axis of the sleeve body extending through the channel. In some embodiments, the attachment mechanism includes a bolt extending through the channel. In some embodiments, a portion of the attachment mechanism protruding from the first end of the sleeve body is a threaded end of the bolt.

In some embodiments, the attachment mechanism includes a handle disposed at the second end of the sleeve body.

In some embodiments, the sleeve body is formed from a hardened polymer material.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION OF SPECIFIC EMBODIMENTS

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

Sleeves for forming holes in concrete slabs can take many different forms and sizes. The present application describes both reusable and non-reusable sleeves. As described in further detail herein, the sleeves can have an inverted tapered geometry that helps facilitate removal of the sleeve from a concrete slab following formation of the concrete slab. The sleeves also include some kind of attachment mechanism for securing the sleeve to a concrete form. This allows a position of the sleeve and the resulting whole it forms to be fixed with respect to the concrete slab.

These and other embodiments are discussed below with reference to FIGS. 1-8; however, those skilled in the art will readily appreciate that the detailed description given herein with respect to these figures is for explanatory purposes only and should not be construed as limiting.

Figure 1:
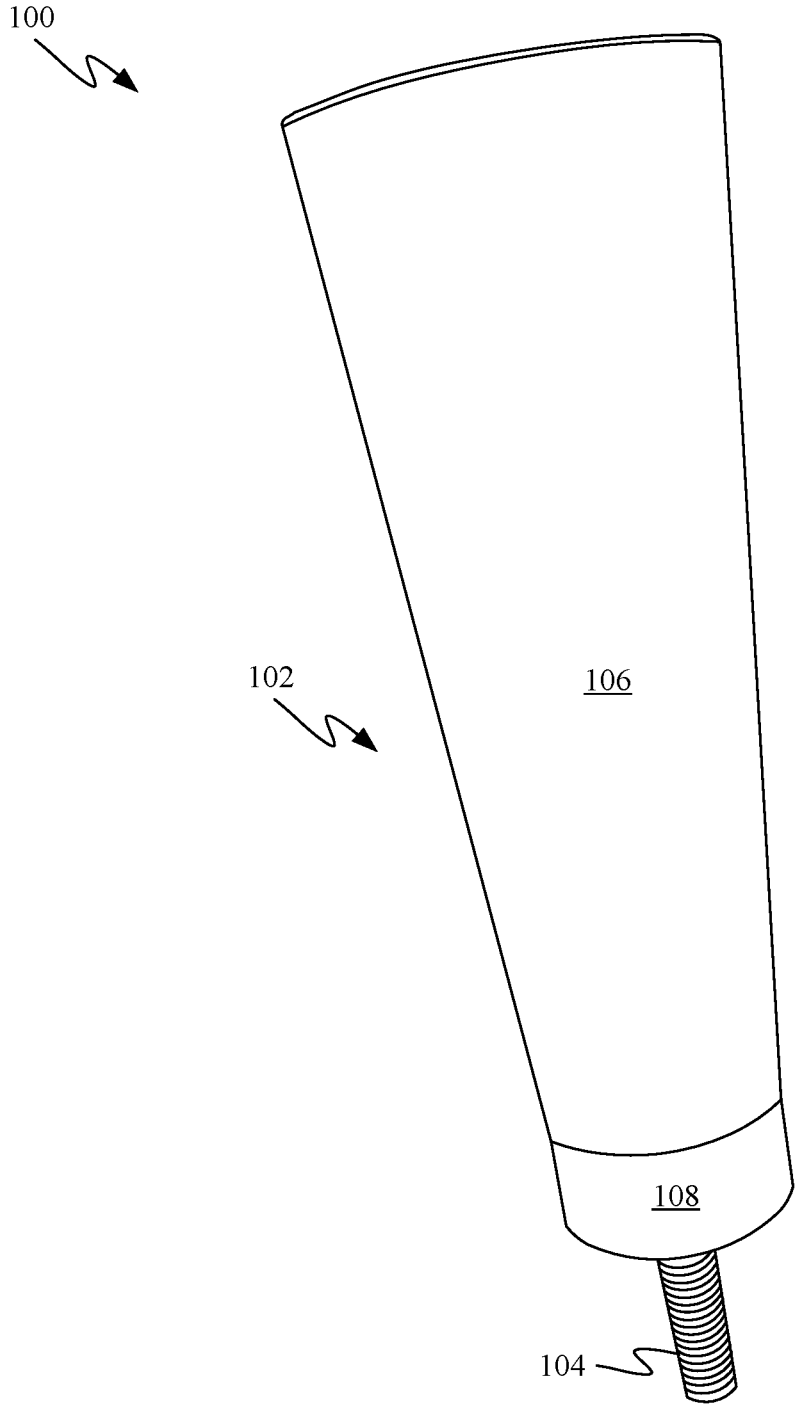
FIG. 1 shows a perspective view of a reusable sleeve that includes a sleeve body and an attachment mechanism.

FIG. 1 shows a perspective view of a reusable sleeve 100 that includes a sleeve body 102 and an attachment mechanism 104. Sleeve body 102 can include a tapered portion 106 and a base portion 108. In some embodiments, tapered portion 106 can have a frusto conical geometry as depicted; however, other variations are possible. More generally, a geometry of tapered portion 106 can have any symmetrical frustum shape, such as a pentagonal or square frustum. Base portion 108, as depicted has a cylindrical geometry 108; however, a geometry of base portion 108 can also match the geometry of any of the various shapes described above for tapered portion 106. Attachment mechanism 104 can take the form of a bolt that extends through at least a portion of sleeve body 102. In some embodiments, attachment mechanism 104 can extend all the way through sleeve body 102.

Figure 2:
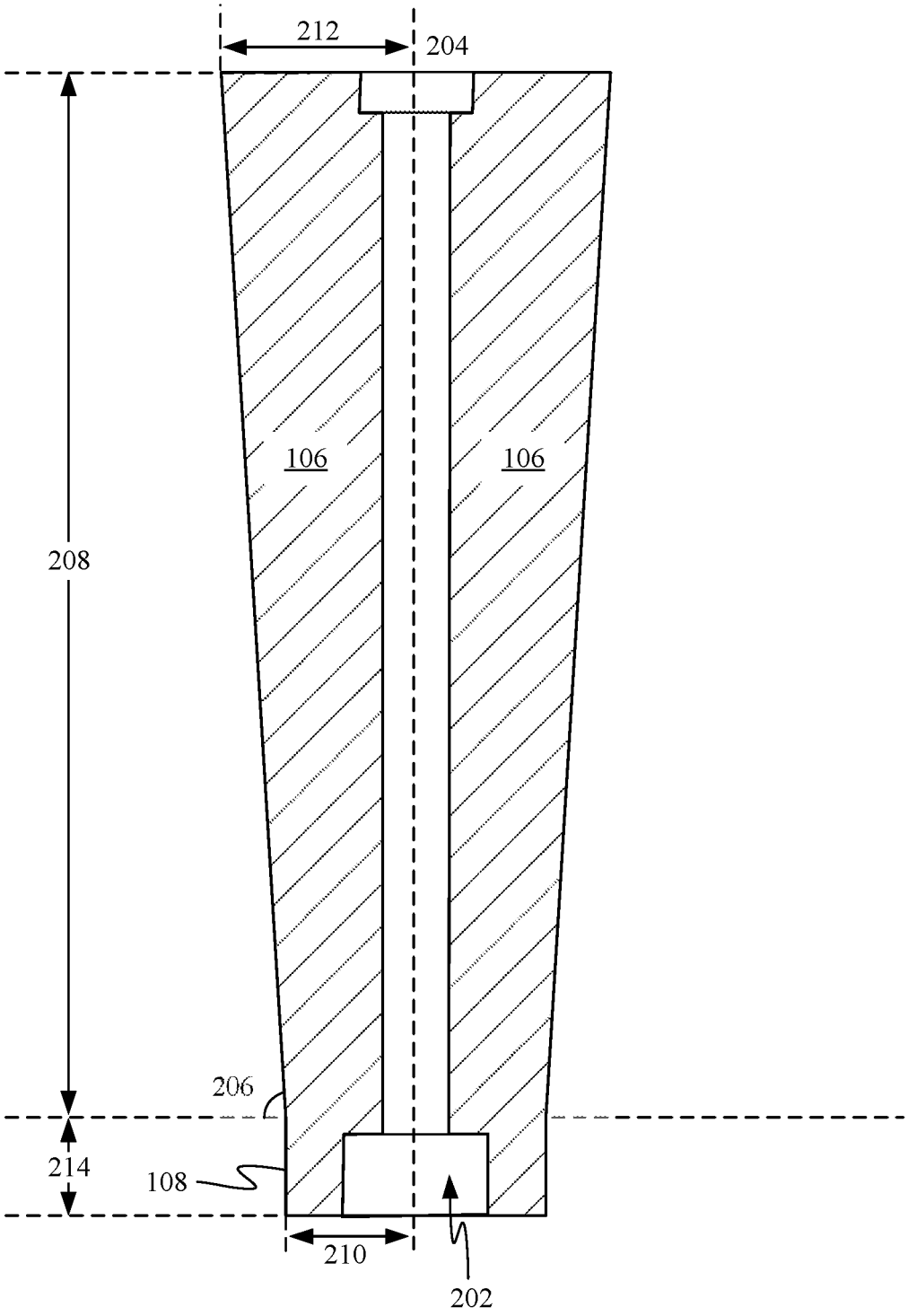
FIG. 2 shows a cross-sectional side view of the sleeve body depicted in FIG. 1.

FIG. 2 shows a cross-sectional side view of sleeve body 102. In particular, a channel 202 is shown following a longitudinal axis 204 of sleeve body 102. As depicted, opposing ends of channel 202 can be enlarged to accommodate a bolt head and nut of attachment mechanism 104 (not depicted). FIG. 2 also depicts how an end of tapered portion 106 joined to base portion 108 can have a very gradual taper with a fixed slope. In some embodiments, angle 206 can be between about 85 and 88 degrees. In some embodiments, angle 206 can be 86.6 degrees. Exemplary measurements, are given below for a sleeve configured to form a hole through an 8 inch concrete slab. A height 208 of tapered portion 106 can be 8 inches. A radius 210 of cylindrical portion 108 can be 1 inch and a radius 212 at a top end of sleeve body 106 can be 1.5 inches. Finally a height 214 of base portion 108 can be 0.75 inches. However, this height can vary between 0.5 and 1 inches. For example, in some embodiments, height 214 can be 22/32 inches to match an actual thickness of a sheet of plywood being used to create a concrete form.

Figure 3A:
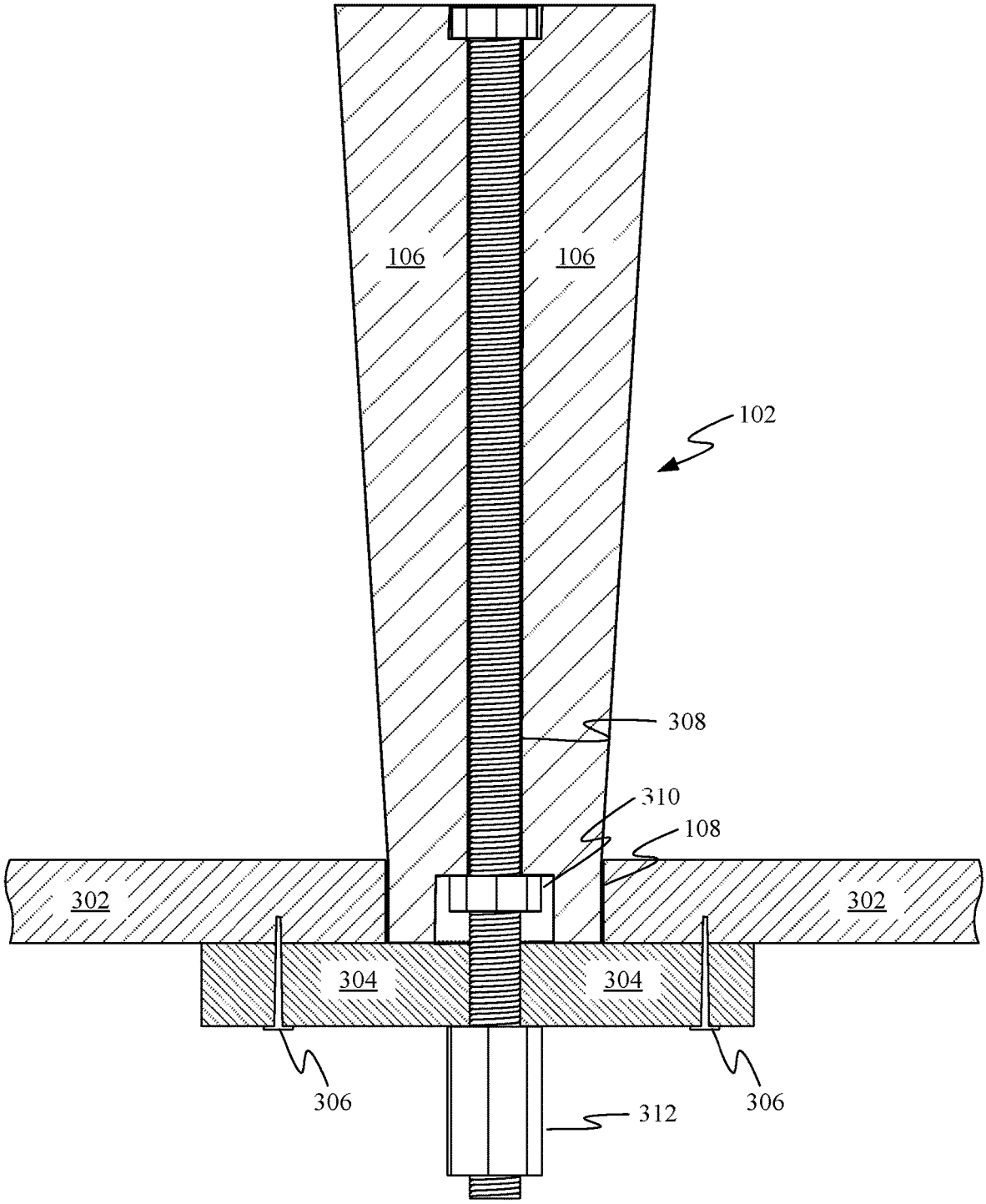
FIG. 3A-3F show a number of cross-sectional side views of the reusable sleeve depicted in FIGS. 1 and 2 installed on a wall of a concrete form during formation of a concrete slab.

FIG. 3A shows a cross-sectional view of reusable sleeve 100 installed on a wall 302 of a concrete form. Wall 302 can take the form of a sheet of plywood with a hole drilled through it to accommodate sleeve body 106. A patch 304 can be affixed to wall 302 to cover the hole drilled through wall 302. In some embodiments, patch 304 can be secured to wall 302 by fasteners 306. In some embodiments, fasteners 306 can take the form of a nail or dry wall screw. In this way a recessed opening is formed that accommodates base portion 108 of sleeve body 102. Attachment mechanism 104 is shown extending through channel 202 of sleeve body 102 and an opening in patch 304. Attachment mechanism 104 is made up of bolt 308, a first nut 310 and a second nut 312. First nut 310 is configured to secure bolt 308 within channel 202 and prevent unwanted rotation of bolt 308 within channel 202. Second nut 312 is used to secure attachment mechanism 104 to wall 302 and patch 304.

Figure 3B:
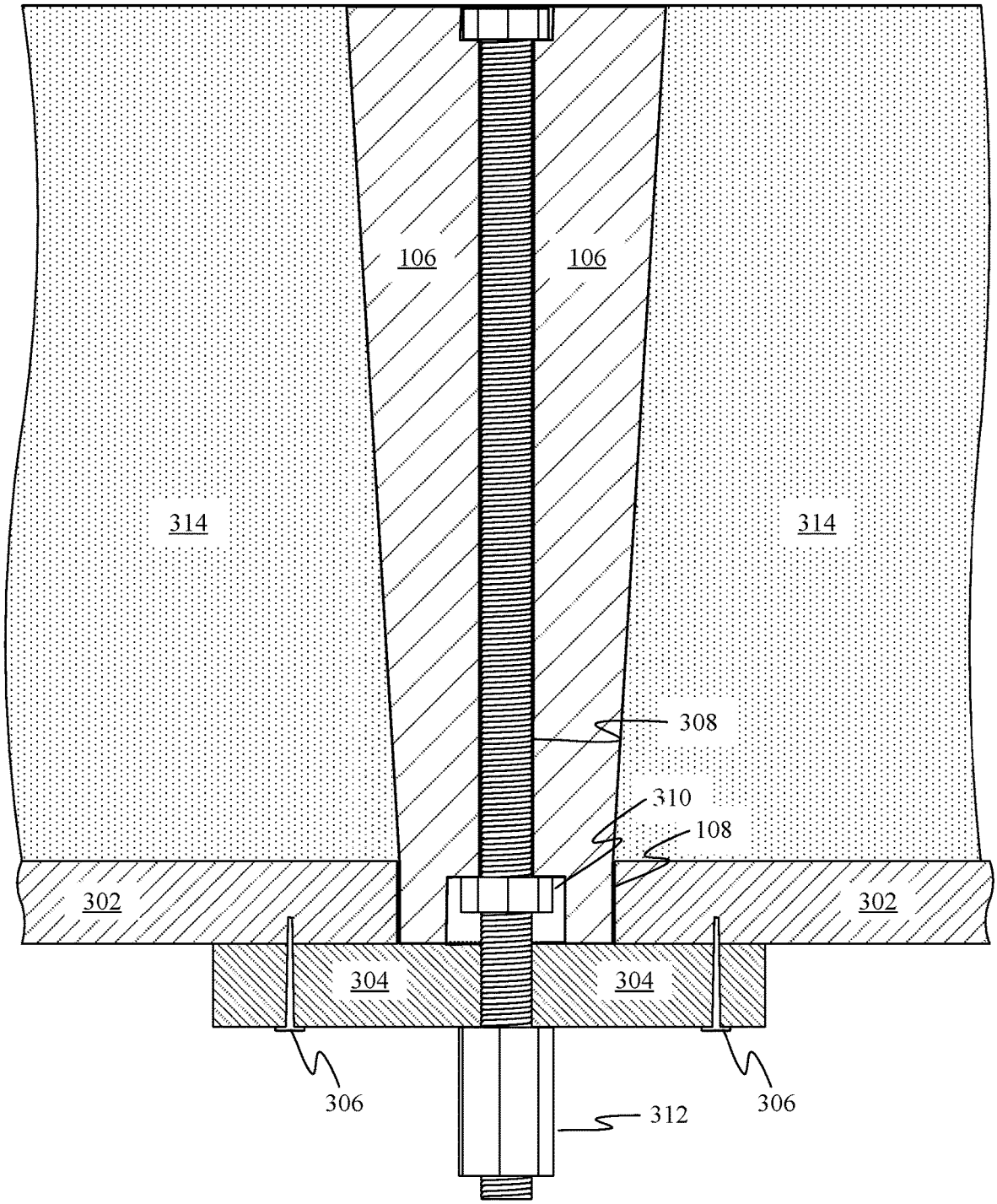
Figure 3C:
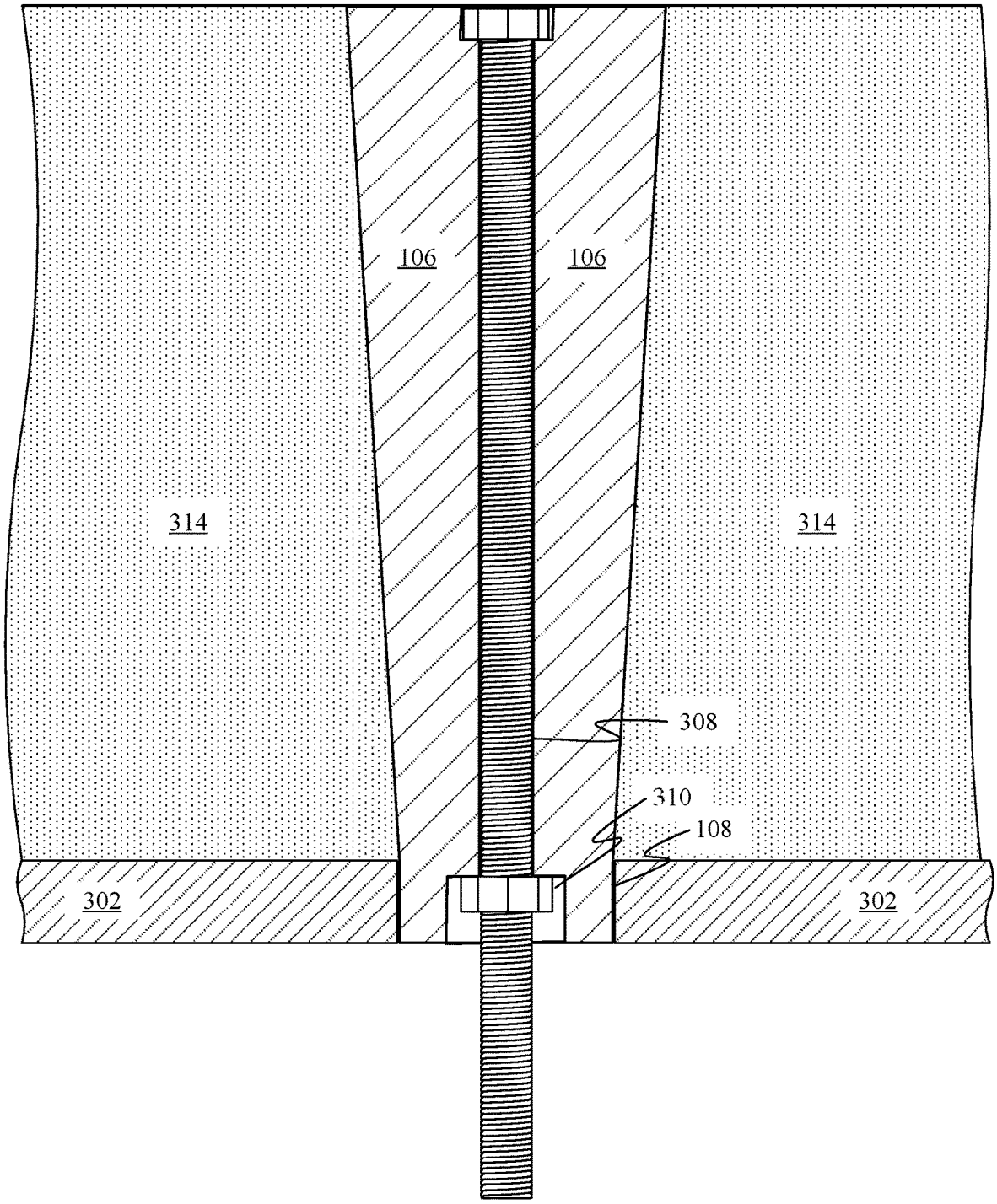
Figure 3D:
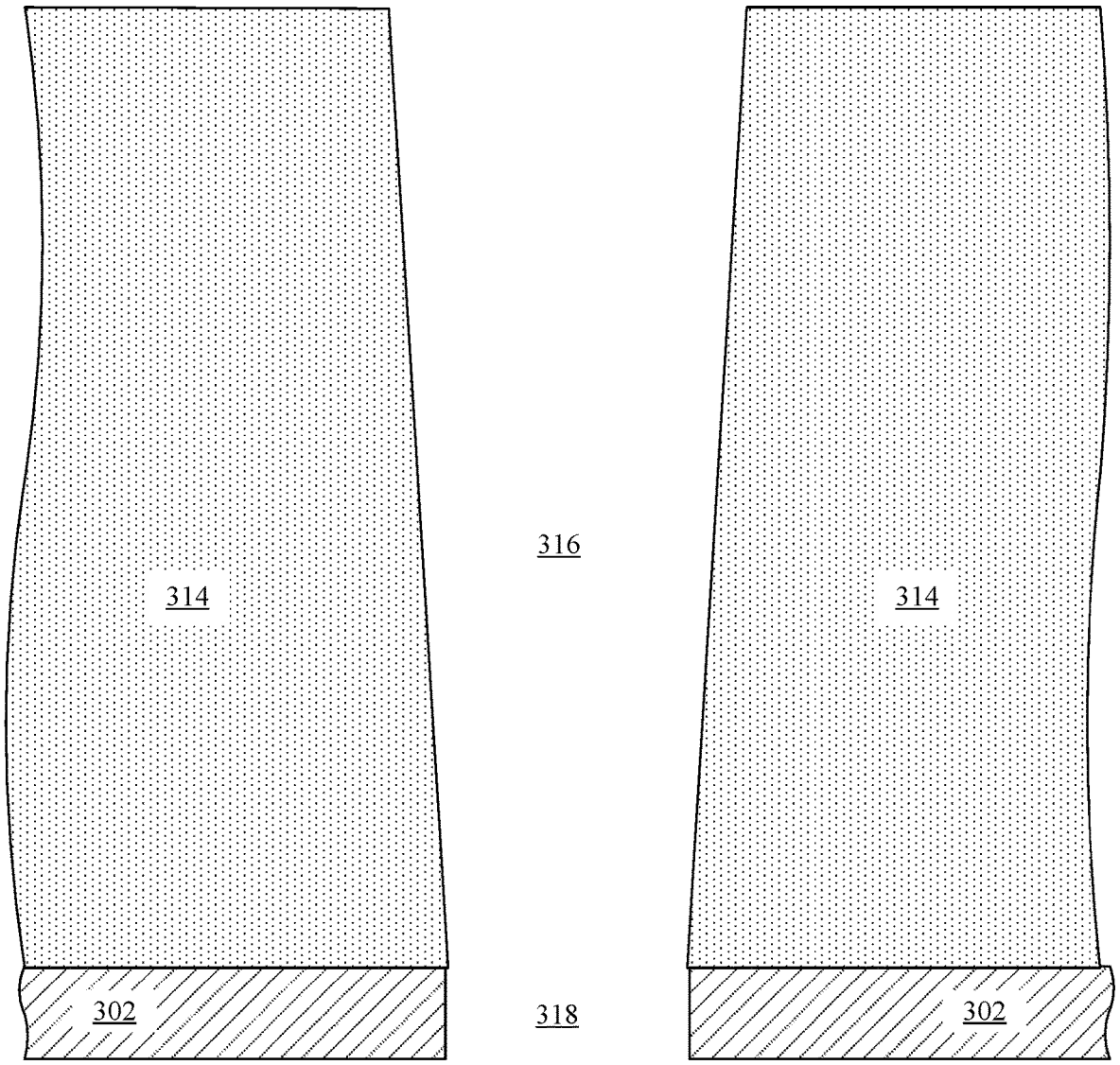
Figure 3E:
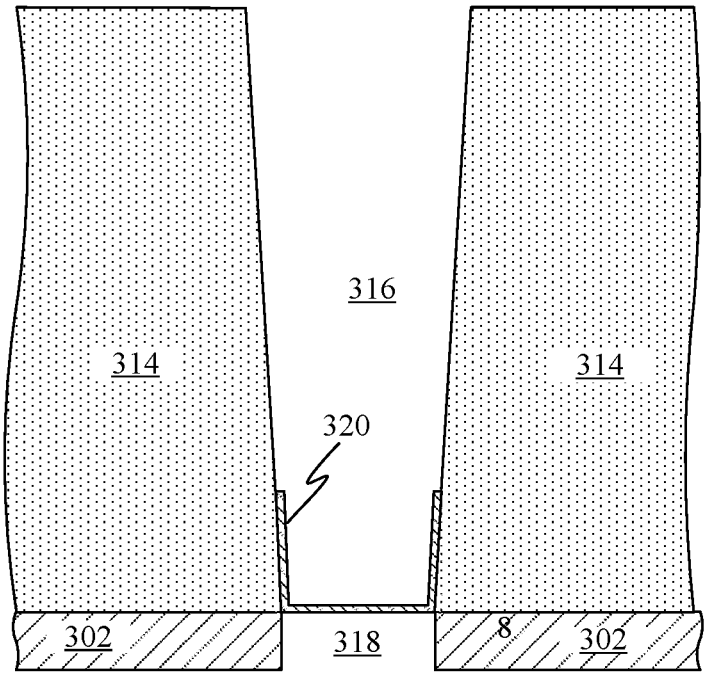
Figure 3F:
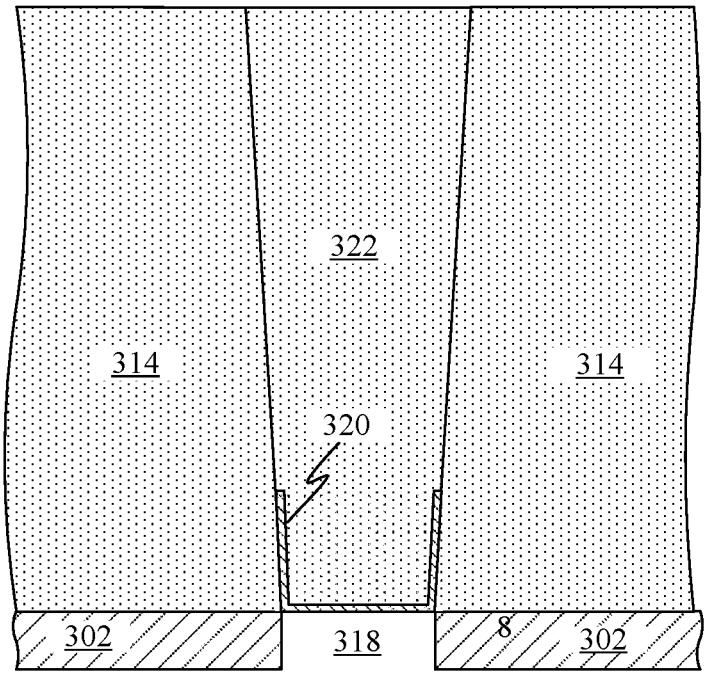

FIG. 3B shows how concrete 314 can fill in and conform around tapered portion 106 of sleeve body 102. In some embodiments, bolt 308 can be configured to stabilize and improve the strength of sleeve 100 during a slab formation process. Sleeve body 106 is sized so that a top level of concrete 314 comes right up to a top surface of sleeve body 106. This prevents a top portion of sleeve 106 from interfering with any smoothing operations applied to a top surface of concrete 314. FIG. 3C shows how first nut 312 and then patch 304 can be removed from wall 302 after concrete 314 is finished at least partially setting. A force can then be applied to a threaded end of bolt 308 and/or base portion 108 of sleeve body 102 to dislodge sleeve 100 from concrete 314. FIG. 3D shows how removal of sleeve 100 leaves a tapered hole 316 extending through both concrete 314 and wall 302. Tapered hole 316 allows for a surveying tool to be shined through tapered opening 316 to align and register relative positions between various floors of a multi-story building. Inlet 318 can have a diameter of about 2 inches to allow for the accommodation of slight inaccuracies in the positioning of sleeve 100 on each floor. FIG. 3E shows how a tapered plug 320 can be lowered into channel 316. A base of tapered plug 320 can have a diameter of about 2 inches to match the diameter of inlet 318, thereby allowing tapered plug 320 to reach the base of concrete 314. The sloped walls of tapered plug 320 match a taper of channel 316 allowing tapered plug to remain securely in place while channel 316 is filled in with additional concrete 322 as shown in FIG. 3F. In some embodiments, a base of tapered plug 320 can be removed subsequent to additional concrete 322 finishing setting. In this way, tapered channel 316 can be used to facilitate alignment of the different floors of the building and then filled back up with additional concrete 322 so that there is little to no effect on a resultant strength of the concrete slab.

Figure 4A:
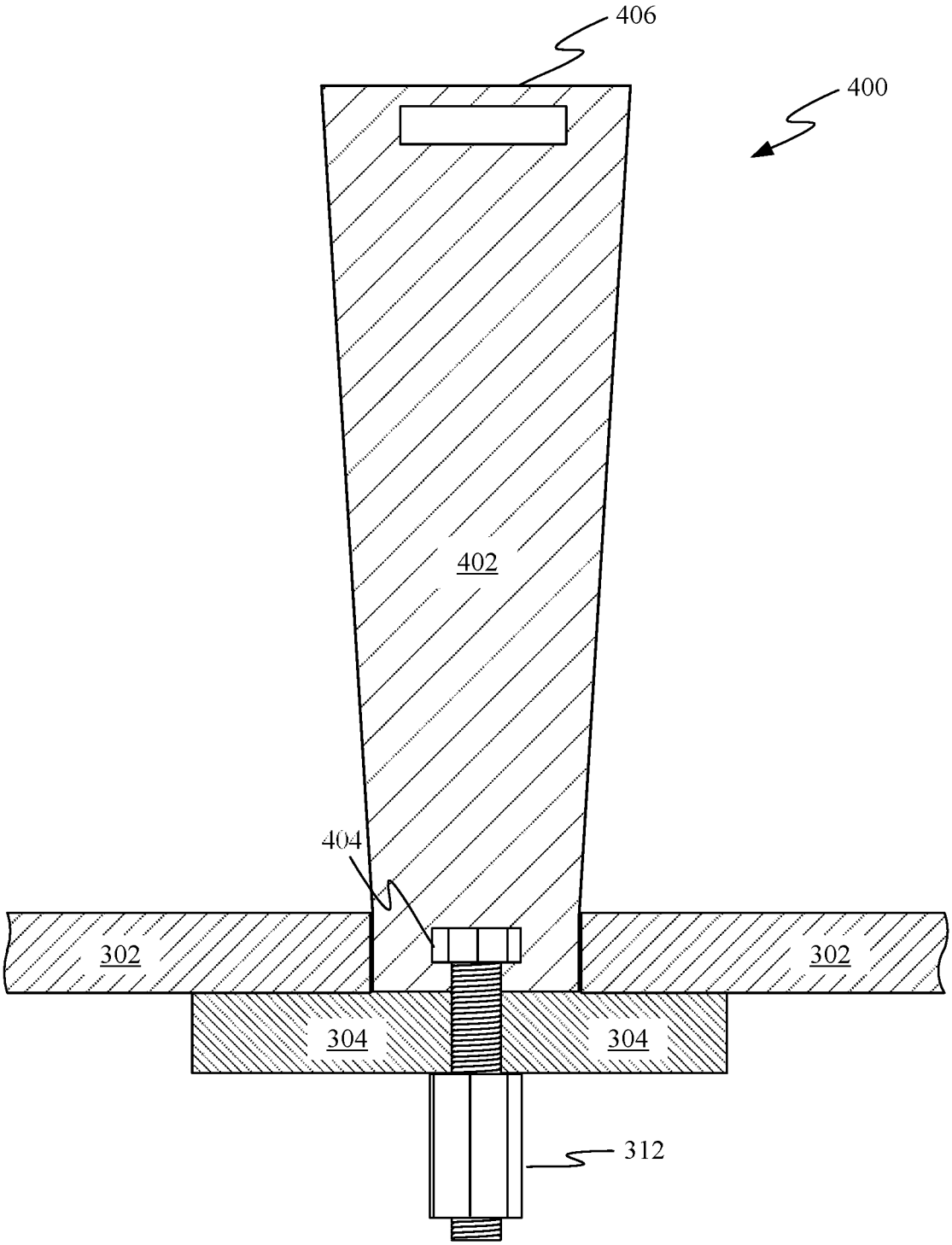
FIG. 4A shows an alternative embodiment in which, a sleeve body encloses a head and an upper portion of a bolt.

FIG. 4A shows an alternative embodiment in which, a sleeve body 402 encloses a head and an upper portion of a bolt 404. In some embodiments, bolt 404 can be partially insert molded within sleeve body 402. In this way, bolt 404 need only extend through a lower portion of sleeve body 402. Flattened surfaces of the head of bolt 404 can prevent bolt 404 from rotating within sleeve body 402. As described before, nut 312 can be used to secure sleeve body 402 to wall 302. Sleeve 402 is also shown including a removal feature 406 taking the form of a handle inset into a top portion of sleeve body 402 that assists in removal of sleeve 400. In this way, removal feature 406 can be incorporated into the top of sleeve body 402 without interfering with a concrete smoothing operation. Removal feature 406 makes removal of sleeve 400 easier and in certain cases may allow for removal of sleeve 400 to be performed by one person instead of two. Removal feature 406 can take other forms including that of a simple loop to which a tool can be attached to assist in the removal of sleeve 400 from a formed concrete slab.

Figure 4B:
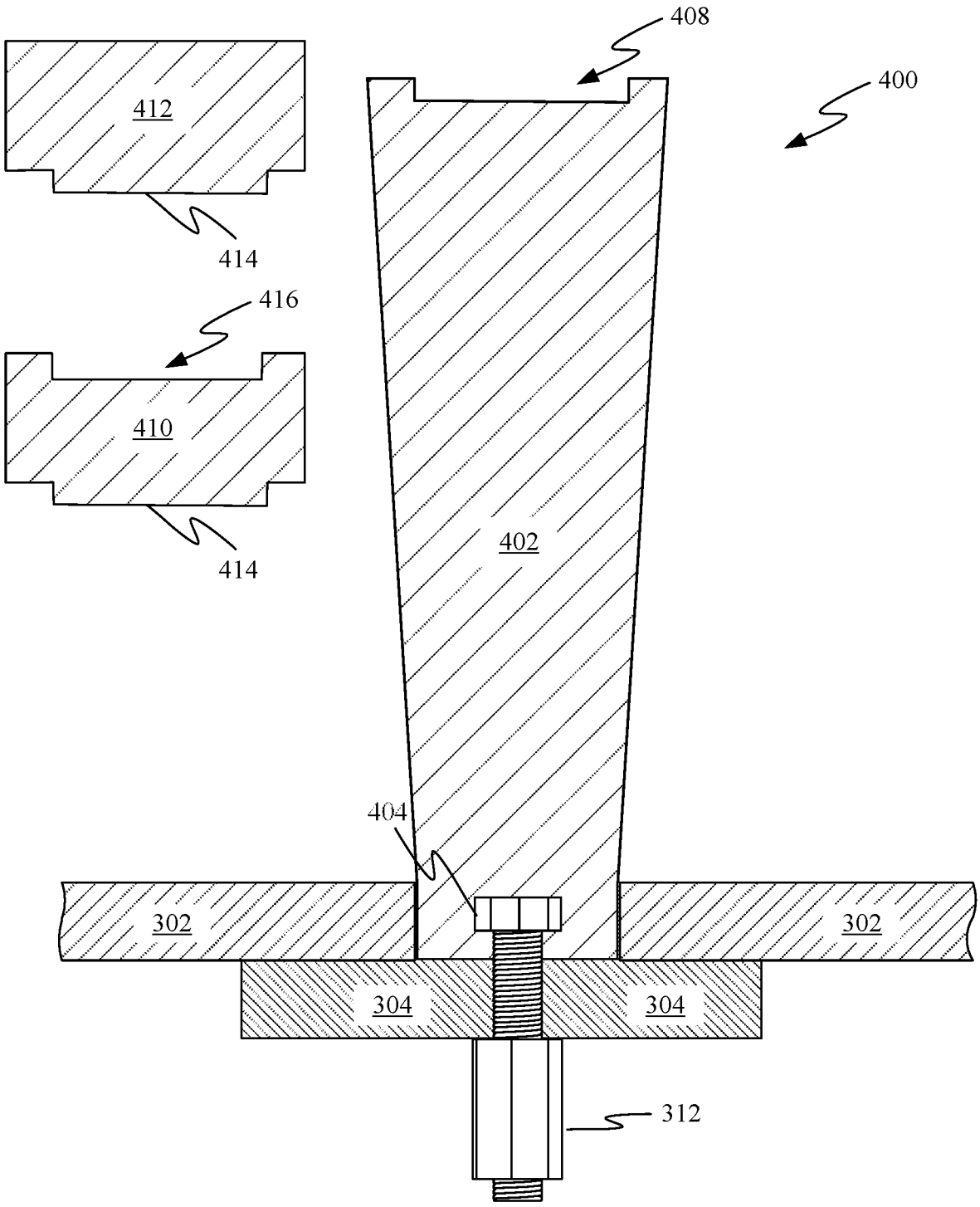
FIG. 4B shows another alternative embodiment in which a sleeve body includes extensions for adapting the sleeve body to concrete slabs of different thickness.

FIG. 4B shows another alternative embodiment in which sleeve body 402 includes a second attachment feature 408 disposed at a top end of sleeve body 402. Attachment feature 408 allows extensions to be added to the top end of sleeve body 402. In particular, extensions 410 and 412 are suitable for attachment to attachment feature 408 and are depicted adjacent to sleeve body 402. Attachment feature 408 can take many forms including a recess sized to facilitate alignment between extension blocks 410 and 412. Extension blocks 410 and 412 can have cylindrical geometries and include cylindrical protrusions 414 that allows extension blocks to engage and stack atop sleeve body 402. In some embodiments, protrusions 414 can include threading configured to engage threading arranged within attachment feature 408. In some embodiments, each of extension blocks 410 and 412 can be configured to add a height of about two inches to sleeve body 402 to handle different thicknesses of concrete slabs; however, a height of extension blocks 410 and 412 can be varied or customized for unusual or custom applications. Extension block 410 is shown including its own attachment feature 416 (e.g., similar to attachment feature 408) to allow extension 412 to stack atop extension 410.

Figure 5:
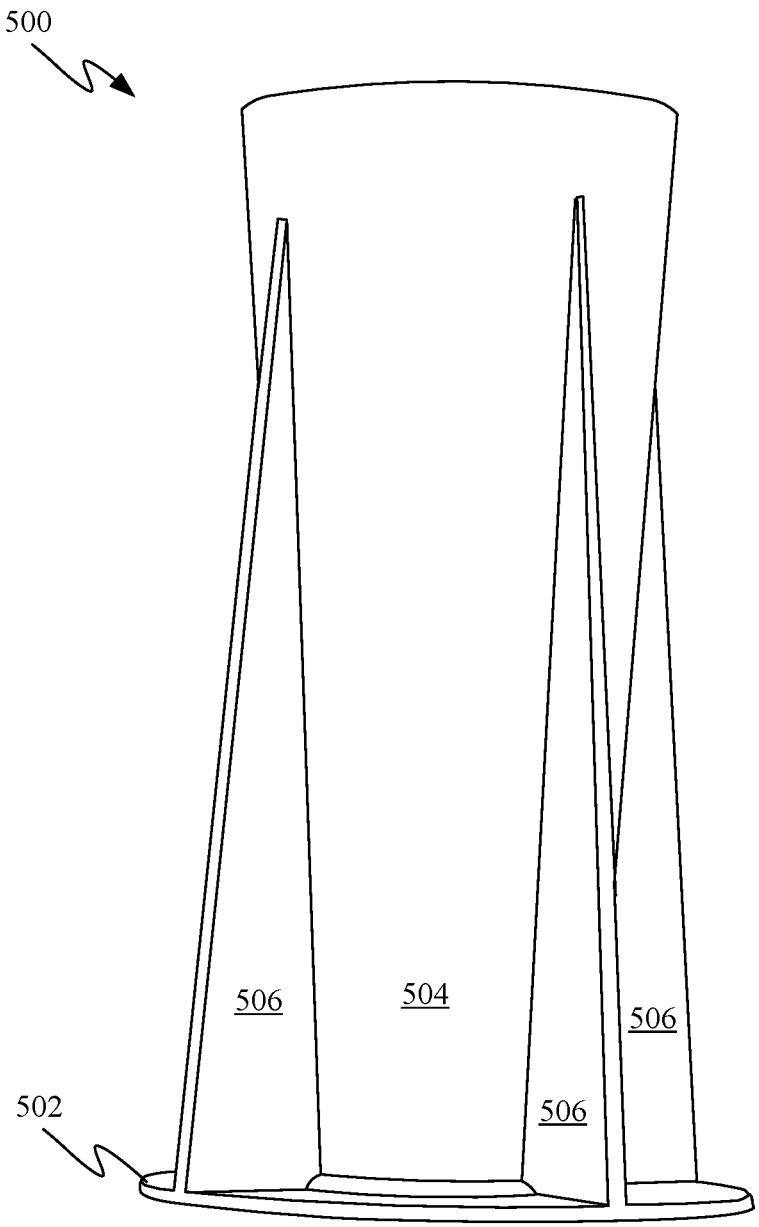
FIG. 5 shows a perspective view of a one-time use sleeve suitable for forming a hole in a concrete slab.

FIG. 5 shows a perspective view of a one-time use sleeve 500 suitable for forming a hole in a concrete slab. One-time use sleeves may in some cases provide additional convenience (and cost savings) over reusable sleeves in that they do not require additional labor involved with removing the sleeve prior to filling the hole with concrete at the end of the alignment process. For example, at the end of the alignment process, such one-time use sleeves may simply be broken apart and discarded. The one-time use sleeves may also in some embodiments be constructed of cheaper materials than reusable sleeves, since the one-time use sleeves only need to perform their task for a relatively short duration as compared to reusable sleeves. In some embodiments, sleeve 500 may be made of a material that is structurally sound so as to withstand pressures as necessary, but also sufficiently brittle or otherwise conducive to breaking so as to allow for easy removal of the sleeve after concrete hardens or partially hardens around sleeve 500. For example, sleeve 500 may be made of a plastic or polymer material such as high density polyethylene (HDPE). Sleeve 500 is hollow in order to reduce a weight and amount of material needed to form sleeve 500. Making sleeve 500 hollow also reduces the amount of time needed to destructively remove sleeve 500 from a concrete slab after formation of the slab is at least partially complete. Sleeve 500 includes attachment flange 502 and sleeve body 504. Sleeve body 504 may be tapered as illustrated in FIG. 5. As illustrated in FIG. 5, sleeve body 504 has a top end and a bottom end extending along a longitudinal axis. As illustrated in FIG. 5, attachment flange 502 of sleeve 500 may be attached to the bottom end of sleeve body 504. Attachment flange 502 may extend laterally outward from the bottom end with respect to the longitudinal axis of sleeve body 504 (e.g., along a plane perpendicular to the longitudinal axis). The attachment flange 502 can include one or more fastening mechanisms for securely coupling sleeve 500 to, for example, a wall of a concrete form. For example, the attachment flange may include fastener openings, each configured to receive a screw, a nail, or a bolt for securely coupling sleeve 500 to a wall of a concrete form. Walls forming sleeve body 504 can be reinforced by structural ribs 506. Structural ribs help to prevent the walls forming sleeve body 504 from undergoing deformation while a concrete slab sets around sleeve 500. Structural ribs 506 allow the walls forming sleeve body 504 to be thinner or formed from a less rigid material than they otherwise could be without structural ribs 506. While three ribs are shown and a fourth rib implied, it should be appreciated that a larger or smaller number of ribs are possible and within the contemplation of the invention. It should also be appreciated that structural ribs can also be formed within hollow sleeve body 504. A number and/or disposition of the ribs can vary, but in some embodiments an X or star shaped rib configuration can be used to increase the rigidity of the walls forming sleeve body 504. In some embodiments, structural ribs formed within sleeve body 504 can be configured to provide support for one or more extensions configured to increase a height of sleeve 500.

Figure 6A:
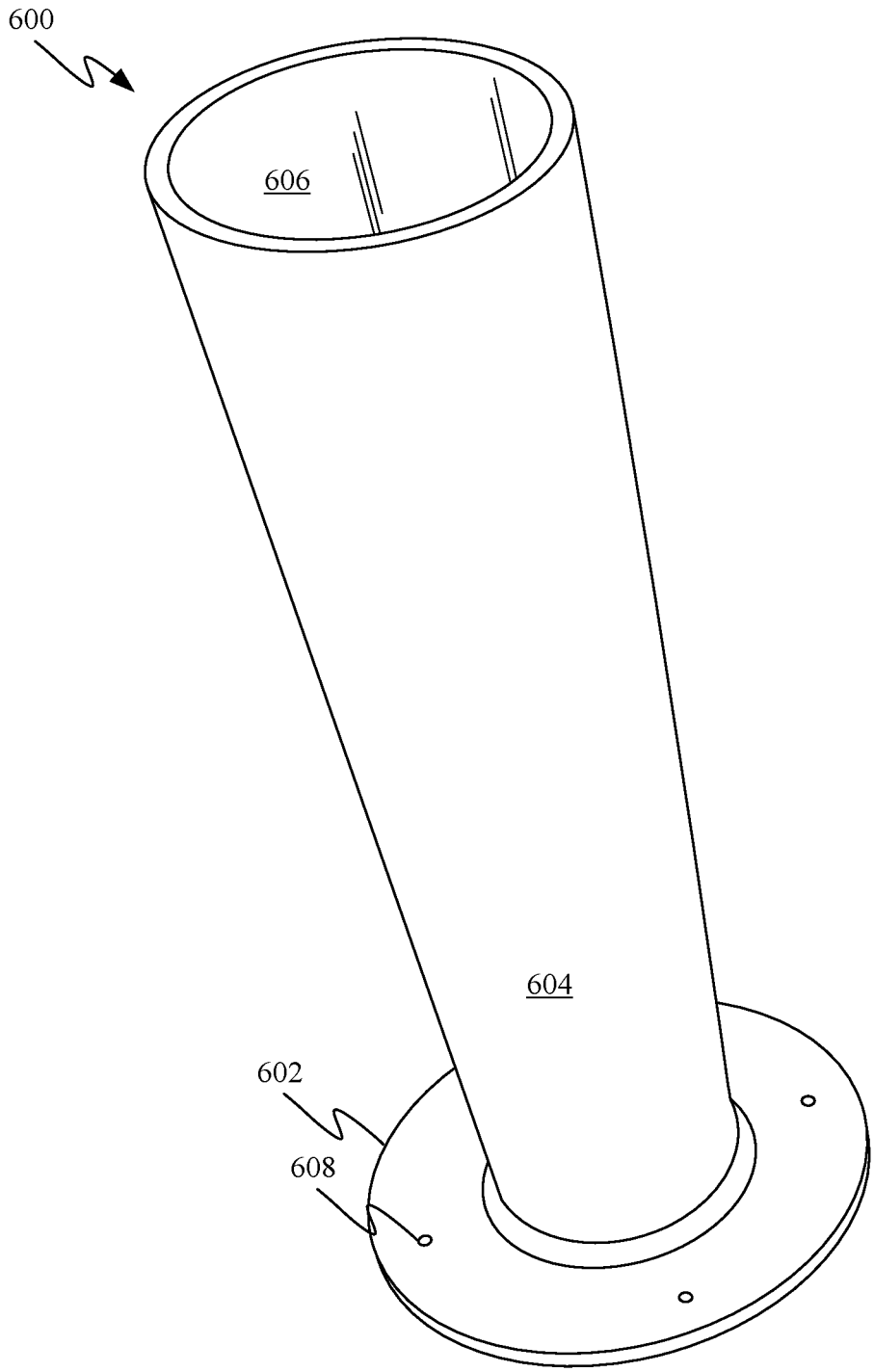
FIG. 6A shows a perspective view of another one-time use sleeve.

FIG. 6A shows a perspective view of another one-time use sleeve 600. Sleeve 600 may be identical to sleeve 500, except that sleeve 600 does not include any structural ribs such as structural ribs 506 in sleeve 500. Sleeve 600 includes an attachment flange 602 and a sleeve body 604, which may be tapered as illustrated in FIG. 6. Sleeve body 604 defines an internal volume 606 configured to reduce the amount of material needed to form sleeve 600. As with sleeve 500, the attachment flange 602 may be attached to the bottom end of sleeve body 604 that extends laterally outward from the bottom end with respect to the longitudinal axis along which the top and bottom ends of the sleeve body extend. As illustrated in FIG. 6, sleeve body 604 has a top end and a bottom end extending along a longitudinal axis. Attachment flange 602 of sleeve 600 may be attached to the bottom end of sleeve body 604. Attachment flange 602 may extend laterally outward from the bottom end with respect to the longitudinal axis of sleeve body 604, and can include one or more fastening mechanisms for securely coupling sleeve 600 to a wall of a concrete form. For example, the attachment flange may include fastener openings 608, each configured to receive a fastener such as a screw, a nail, or a bolt for affixing sleeve 600 to a wall of a concrete form. In some embodiments, sleeve 600 can be formed of sheet metal or other robust material so that the walls of cylindrical portion 604 are able to withstand pressures exerted by the concrete slab as the concrete slab hardens around sleeve 600. In some embodiments, similar to sleeve 500, sleeve 600 may be made of a material (e.g., a plastic such as HDPE) that is structurally sound so as to withstand pressures as necessary, but also sufficiently brittle or otherwise conducive to breaking so as to allow for easy removal of the sleeve after the concrete hardens around sleeve 600. In some embodiments, an opening leading into the interior of sleeve 600 can be closed by a cap that prevents stray concrete from entering sleeve 600 and making it harder to remove. In some embodiments, the cap can be removable while in other embodiments, the cap can be removed by cutting it away or otherwise disconnecting it from sleeve 600.

Figure 6B:
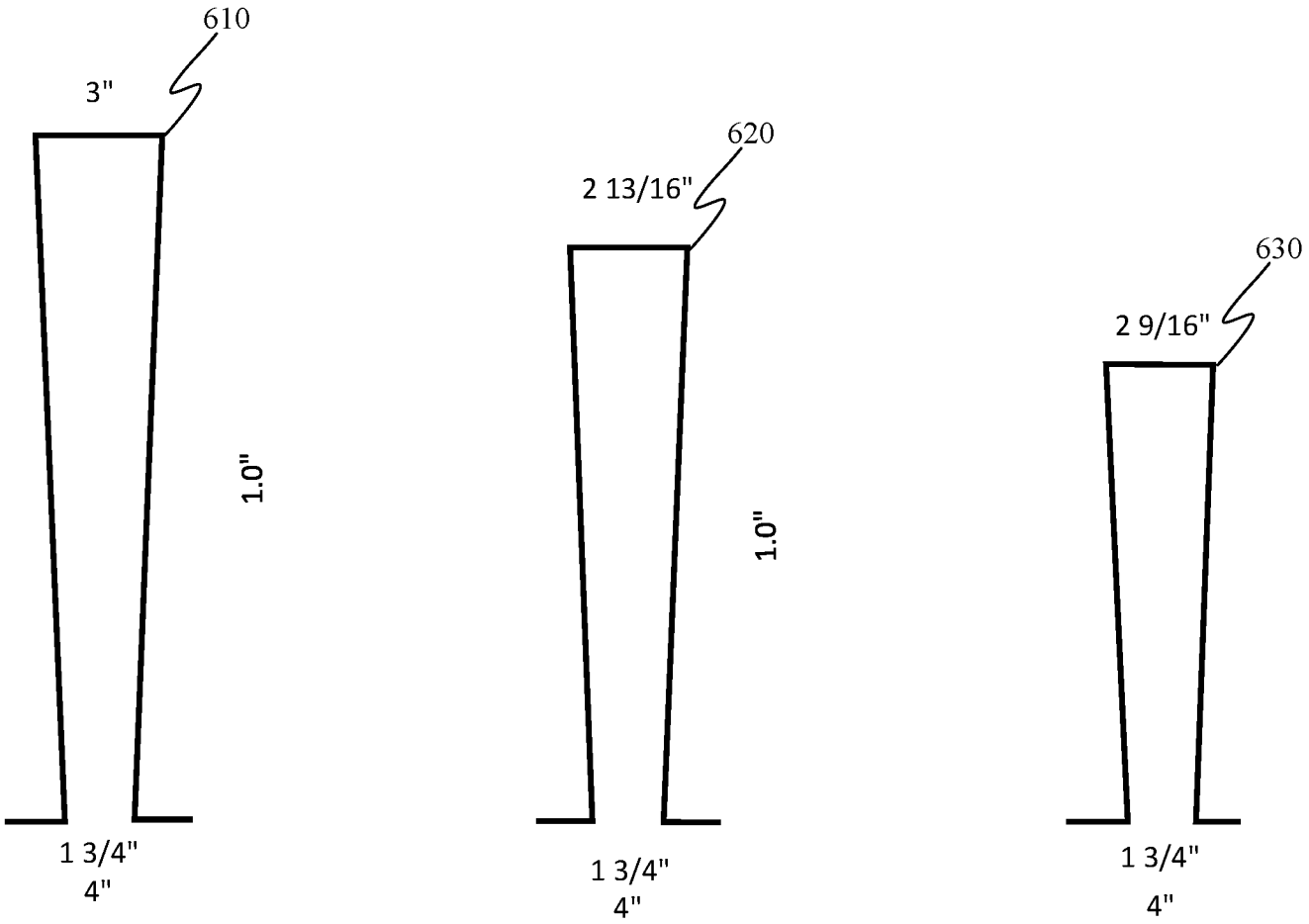
FIG. 6B shows cross-section schematics of different example embodiments of the sleeve in FIG. 6A.

FIG. 6B shows cross-section schematics of different example embodiments of the sleeve in FIG. 6A. The example sleeve 610 has a height of about 1 foot (about 30.48 cm), with a top diameter of the tapered portion of about 3 inches (about 7.62 cm), a bottom diameter of the tapered portion of about 1¾ inches (about 4.45 cm), and an outer diameter of the base portion of about 4 inches (about 10.16 cm). The example sleeve 620 has a height of about 10 inches (about 25.4 cm), with a top diameter of the tapered portion of about 2 13/16 inches (about 7.14 cm), a bottom diameter of the tapered portion of about 1¾ inches (about 4.445 cm), and an outer diameter of the base portion of about 4 inches (about 10.16 cm). The example sleeve 630 has a height of about 8 inches (about 20.32 cm), with a top diameter of the tapered portion of about 2 9/16 inches (about 6.51 cm), a bottom diameter of the tapered portion of about 1¾ inches (about 4.445 cm), and an outer diameter of the base portion of about 4 inches (about 10.16 cm).

Figure 7A:
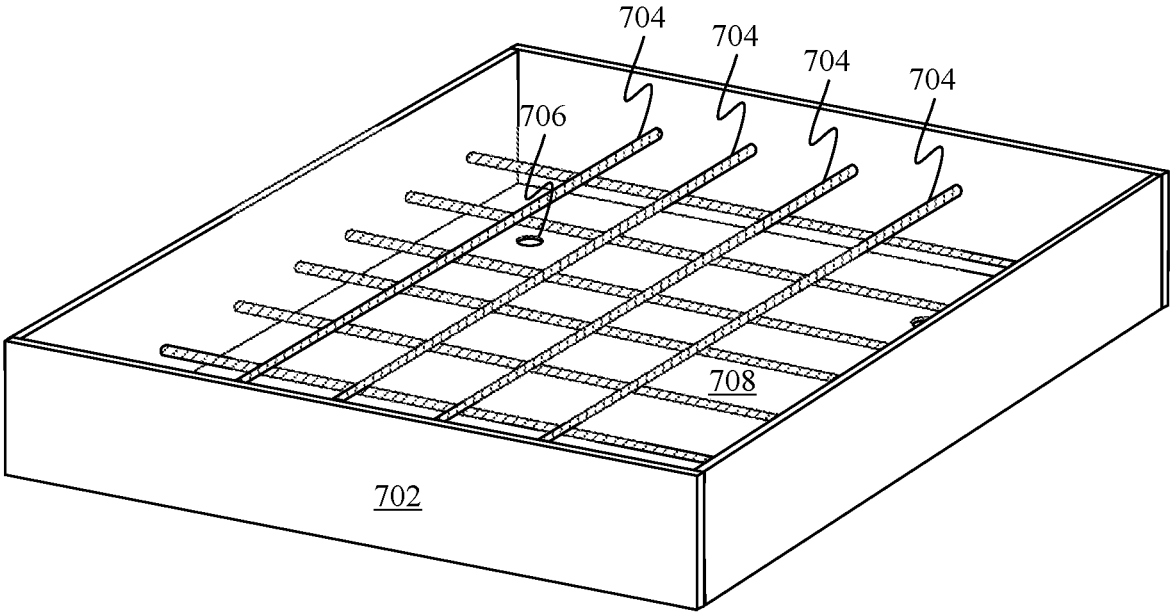
FIGS. 7A-7F show a series of illustrations demonstrating a use case for the sleeves described herein.

FIGS. 7A-7D show a series of illustrations demonstrating a use case for the sleeves described herein. Sleeve 100 is depicted for exemplary purposes only and it should be appreciated that any of the described sleeves could be used. FIG. 7A shows a concrete form 702 formed from multiple sheets of plywood. Metal rebar 704 is arranged within concrete form 702 to add strength to a resulting concrete slab. One or more holes 706 are formed in a base sheet 708 of concrete form 702 and sized to accommodate base portions of sleeves. For example, a hole 706 may correspond to the opening formed in wall 302 and as shown in FIG. 3. As another example, referencing FIGS. 6A-6B, hole 706 may be sized to mate with the bottom diameter of the tapered portion of sleeve 600. In this example, at least a portion of the attachment flange of sleeve 600 would extend around the hole, and may be fastened by fasteners (e.g., screws or nails) to base sheet 708.

Figure 7B:
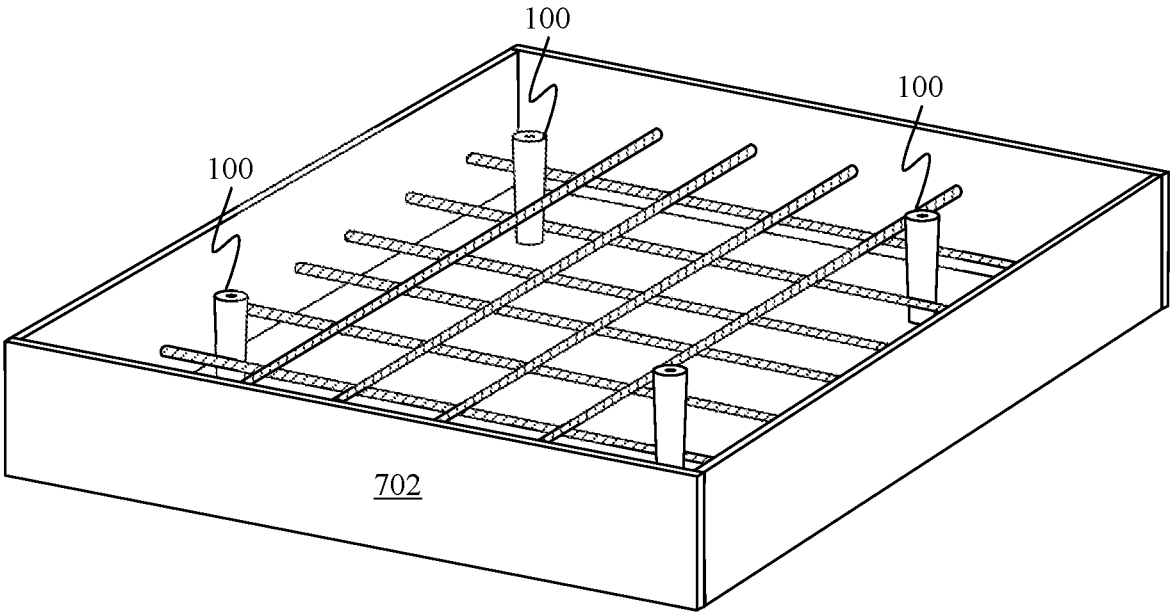

FIG. 7B shows four sleeves 100 affixed to base sheet 708 near the corners of concrete form 702. It should be appreciated that while a rather modestly sized concrete form 702 is shown that the described invention also scales and much larger concrete slabs are contemplated and within the scope of the inventive concept. For example, the described embodiments have been tested and used with a concrete slab having dimensions of 200 ft×120 ft (or about 60.96 m×36.58 m).

Figure 7C:
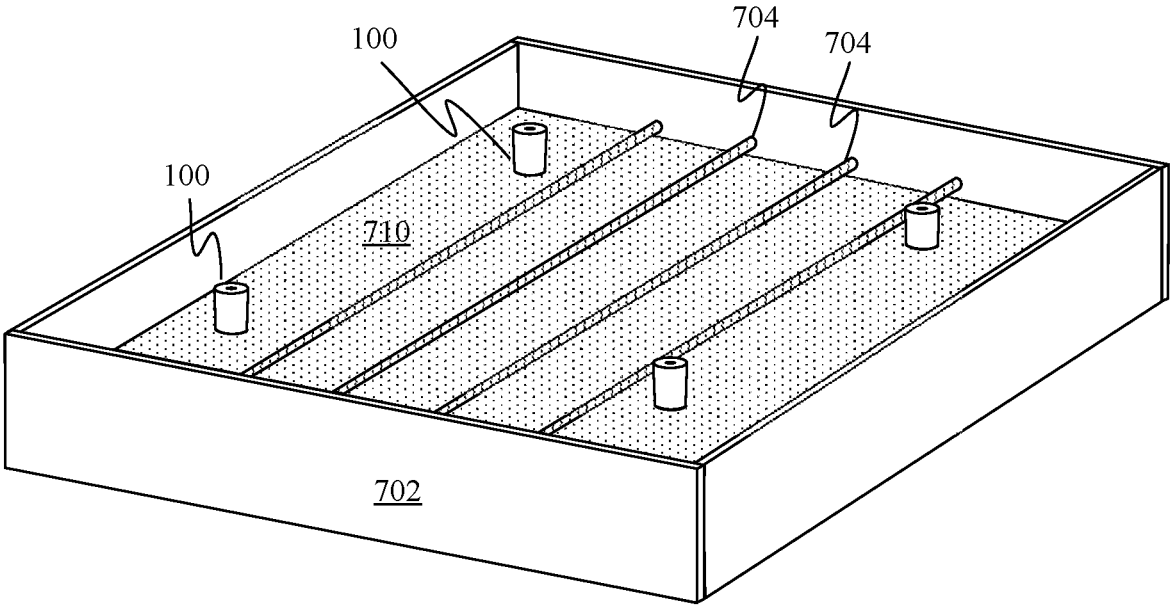

FIG. 7C shows how concrete form 702 can be gradually filled with concrete 710. While an amount of concrete 710 added to concrete form 702 is typically predetermined, sleeves 100 can provide an indication of the amount of progress being made in filling concrete form 702. In some embodiments, sleeves 100 can include measurement indicators along the side or the tapered portion of the sleeve body allowing, for example, a better indication of how close to full the concrete form is.

Figure 7D:
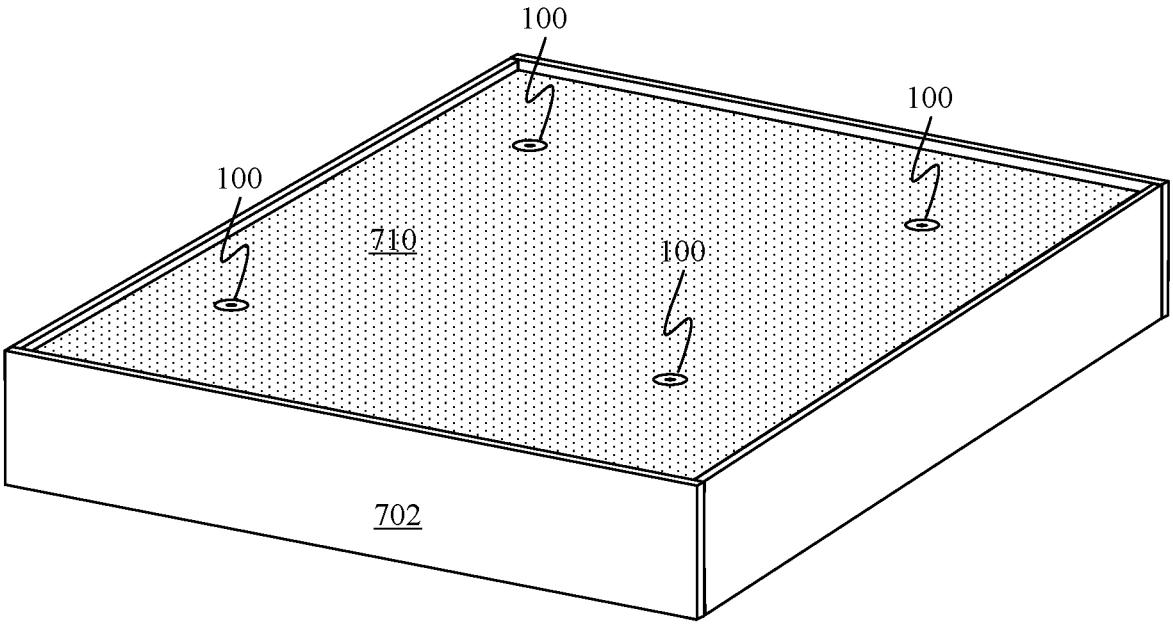
Figure 7E:
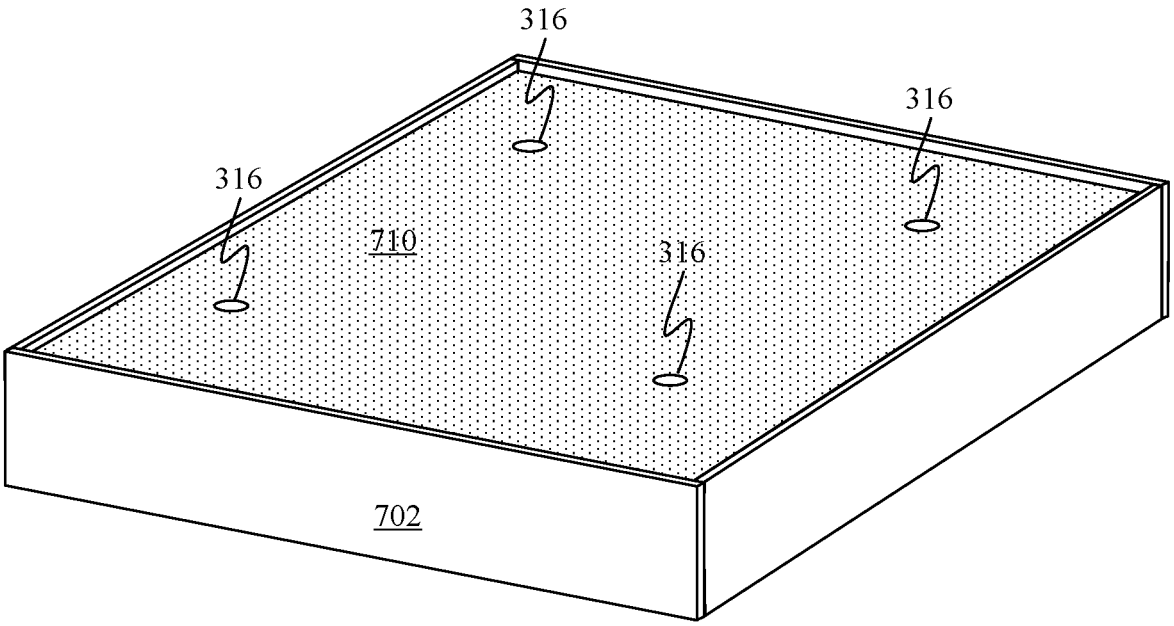

As shown in FIG. 7D, in some embodiments, sleeves 100 can be an excellent way of confirming a flatness of the resulting concrete slab since sleeves 100 can be the same height as the resulting concrete slab (or alternatively, measurement indicators on sleeves 100 can be checked to make sure that the concrete heights at the different locations corresponding to the sleeves are all equal or approximately equal). This flat upper surface and matching height prevents sleeves 100 from interfering in finishing operations that smooth an upper surface of the concrete slab prior to setting. After concrete 710 has hardened (or partially hardened), sleeves 100 may be removed from concrete 710. An example method of removing an embodiment of a reusable sleeve is illustrated in FIGS. 3C-3D. As for one-time use sleeves such as sleeves 500 and 600 in FIGS. 5 and 6A, these sleeves may be broken and removed. FIG. 7E shows tapered channels 316 left behind after removing sleeves 100 from concrete 710.

Figure 7F:
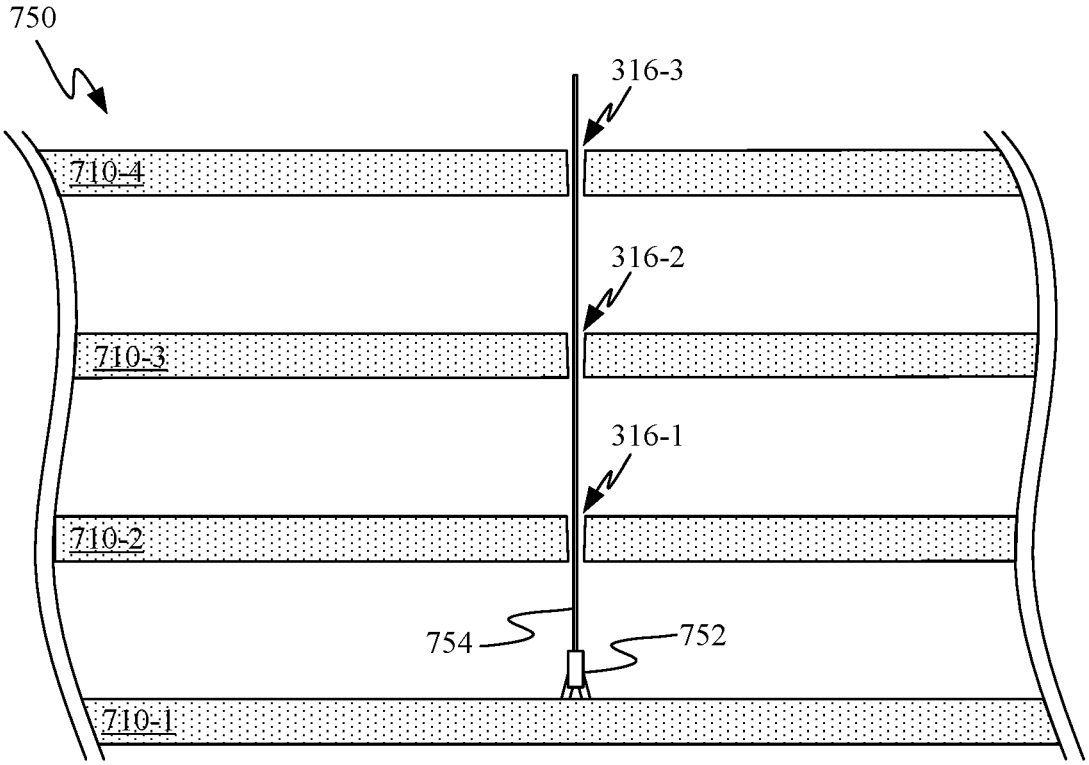

FIG. 7F shows how an optical beam source such as a laser 752 can be positioned on a base floor atop a concrete slab 710-1 of a building 750. A position of laser 752 can be chosen to coincide with a blueprint datum or other identifiable feature of building 752. A location of each of tapered channels 316 can be identified by shining the laser onto a base of a concrete form associated with each of concrete slabs 710-1 to 710-4. For example, once tapered channel 316-1 is formed, laser 752 can shine through tapered channel 316-1 to mark a position for tapered channel 316-2. Prior to filling up each of tapered channels 316, as described above, an at least partially translucent laser target that covers the opening can be positioned immediately above each of tapered channels 316. An outline of the laser target can be scribed around the tapered opening so that once tapered opening is filled, a precise location defined by a laser beam 754 emitted by laser 752 can be marked on each of concrete slabs 710 so that inaccuracies due to any minor misalignment of tapered channels 316 can be ameliorated. In this way, builders can have a consistent reference point from floor to floor so as to avoid any drift or skewing of datums between floors. It should be noted that tapered channels 316 can be formed in each corner of slabs 710 or in a different pattern or number depending upon a geometry or other design features of a building 750. Furthermore, in some large buildings multiple slabs could be positioned adjacent to one another on each floor. In such a configuration, each adjacent slab would include its own tapered channels 316.

The various sleeve bodies illustrated and described in this disclosure extend along a longitudinal axis between a top end and a bottom end. A sleeve body may be constructed to have an inverted taper such that the top end of the sleeve body is wider than the bottom end of the sleeve body. For example, a cross-section of the top end (taken perpendicular to the longitudinal axis) may be greater than a cross-section of the bottom end (again taken perpendicular to the longitudinal axis). An inverted taper is advantageous in that it facilitates easy removal of the sleeve from a point above the concrete slab. For example, with a reusable sleeve, the sleeve can be slid upward out of the tapered channel that may be left behind. This would not be possible with a conventional tapered sleeve that is tapered in a non-inverted manner (i.e., with the bottom end being wider than the top end), because concrete hardening around the top portion of the sleeve would prevent such removal. The removal is similarly simplified with a one-time sleeve, because even if the one-time sleeve can be broken, the inverted taper provides easier access for breaking and removal of the pieces of the sleeve. Sleeves with inverted tapers are also advantageous in that they leave behind inverted tapered channels that facilitate insertion of plugs from a point above the concrete slab. That is, as illustrated in FIGS. 3E-3F and as described above in the associated text, a suitable dimensioned plug (e.g., a plug with a substantially matching inverted taper) similar to plug 320 may be lowered into the tapered channel until it is naturally secured in place due to its dimensions. Such easy insertion of the plug would not be possible with a taper created by a conventional, non-inverted sleeve.

Figure 8:
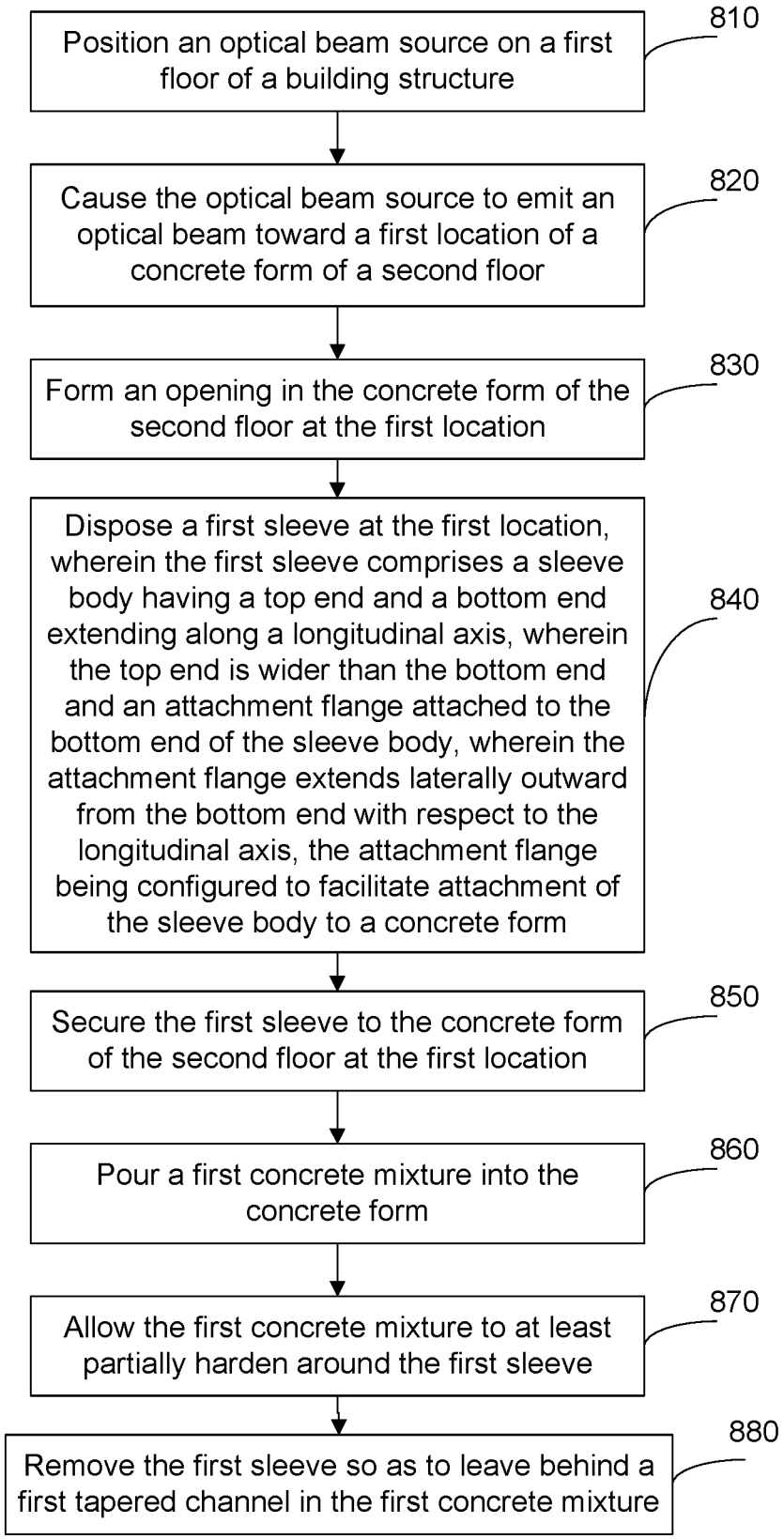
FIG. 8 illustrates an example method for aligning concrete slabs of a building structure.

FIG. 8 illustrates an example method 800 for aligning concrete slabs of a building structure. The method may include, at step 810, positioning an optical beam source (e.g., a laser, an infrared source) on a first floor of a building structure. At step 820, the method may include causing the optical beam source to emit an optical beam (e.g., a laser beam, an infrared beam) toward a first location of a concrete form of a second floor. At step 830, the method may include forming an opening in the concrete form of the second floor at the first location. At step 840, the method may include disposing a first sleeve at the first location. The first sleeve may include a sleeve body having a top end and a bottom end extending along a longitudinal axis, wherein the top end is wider than the bottom end; and an attachment flange attached to the bottom end of the sleeve body, wherein the attachment flange extends laterally outward from the bottom end with respect to the longitudinal axis, the attachment flange being configured to facilitate attachment of the sleeve body to a concrete form. At step 850, the method may include securing the first sleeve to the concrete form of the second floor at the first location (e.g., by inserting one or more screws, nails, bolts, or other fasteners into one or more fastener openings of the attachment flange). At step 860, the method may include pouring a first concrete mixture into the concrete form. At step 870, the method may include allowing the first concrete mixture to at least partially harden around the first sleeve. At step 880, the method may include removing the first sleeve so as to leave behind a first tapered channel in the first concrete mixture.

In some embodiments, the method may further include orienting the optical beam such that the optical beam is perpendicular to the first floor, and confirming that the optical beam travels through the first tapered channel such that the optical beam is perpendicular to the second floor. In some embodiments, the method may further include causing the optical beam to travel through the first tapered channel toward a second location of a concrete form of a third floor; forming an opening in the concrete form of the third floor at the second location; and securing a second sleeve to the concrete form of the third floor at the second location. The method may further include removing the second sleeve so as to leave behind a second tapered channel; and confirming that the optical beam travels through the first tapered channel and the second tapered channel.

In some embodiments, the method may further include positioning, through the first tapered channel, a tapered plug dimensioned to fit at a bottom of the first tapered channel; and pouring a second concrete mixture into the first tapered channel.

In embodiments where the sleeve is a one-time use sleeve, removing the first sleeve may include breaking the sleeve body and/or the attachment flange. In embodiments where the sleeve is reusable, the sleeve may be removed without breaking the sleeve body (e.g., by removing the fasteners from the fastener openings of the attachment flange and pulling out the sleeve body from the concrete).

Although this disclosure describes and illustrates particular steps of the method for aligning concrete slabs of a building structure as occurring in a particular order, this disclosure contemplates any suitable steps of such a method occurring in any suitable order. Moreover, although this disclosure describes and illustrates an example method for aligning concrete slabs of a building structure, including the particular steps illustrated in, for example, the method of FIG. 8, this disclosure contemplates any suitable method for aligning concrete slabs of a building structure, including any suitable steps, which may include all, some, or none of the steps of the method of FIG. 8, where appropriate. Furthermore, although this disclosure describes and illustrates particular components, devices, or systems carrying out particular steps of methods (e.g., the steps illustrated in FIG. 8) for aligning concrete slabs of a building structure, this disclosure contemplates any suitable combination of any suitable components, devices, or systems carrying out any suitable steps of such method. Finally, although the disclosure focuses on aligning concrete slabs, the disclosure contemplates aligning any other suitable construction unit composed of any suitable mixture that is capable of being poured and hardened around a sleeve.

The various aspects, embodiments, implementations or features of the described embodiments can be used separately or in any combination. Various aspects of the described embodiments can be implemented by software, hardware or a combination of hardware and software. The described embodiments, and particularly the surveying equipment, can also be embodied as computer readable code on a computer readable medium for controlling the measurement operations described herein. The computer readable medium is any data storage device that can store data, which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A sleeve for forming a channel through a concrete slab, the sleeve comprising:

a sleeve body having a top end and a bottom end extending along a longitudinal axis, wherein:

the top end has a first cross-sectional area perpendicular to the longitudinal axis and the bottom end has a second cross-sectional area perpendicular to the longitudinal axis;

the first cross-sectional area of the top end is greater than the second cross-sectional area of the bottom end; and the sleeve body comprises an optically transparent or translucent portion configured to permit an optical beam to pass therethrough; and an attachment flange attached to the bottom end of the sleeve body, wherein the attachment flange extends laterally outward from the bottom end with respect to the longitudinal axis, the attachment flange being configured to facilitate attachment of the sleeve body to a concrete form.

2. The sleeve of claim 1, wherein the sleeve body is tapered between the top end and the bottom end, such that a cross-sectional area of the sleeve body perpendicular to the longitudinal axis incrementally decreases from the top end to the bottom end.

3. The sleeve of claim 1, wherein the attachment flange extends along a plane perpendicular to the longitudinal axis.

4. The sleeve of claim 3, wherein the attachment flange has a cross-sectional area perpendicular to the longitudinal axis that is greater than a cross-sectional area of the sleeve body at the bottom end.

5. The sleeve of claim 4, wherein the cross-sectional area of the attachment flange is greater than the cross-sectional area of the sleeve body at the top end.

6. The sleeve of claim 1, wherein the sleeve body has a cone-shaped geometry, and wherein the attachment flange has a circular geometry that extends radially outward from the bottom end with respect to the longitudinal axis.

7. The sleeve of claim 6, wherein cross-sections along the sleeve body perpendicular to the longitudinal axis are circular.

8. The sleeve of claim 1, wherein the sleeve body is hollow, such that the sleeve body defines a channel, the longitudinal axis extending through the channel.

9. The sleeve of claim 1, wherein the attachment flange comprises one or more fastener openings, each configured to receive a screw, a nail, or a bolt for affixing the attachment flange to a wall of the concrete form.

10. A sleeve system comprising:

an attachment flange configured to be attached to a concrete form around an opening in the concrete form; and a sleeve body having a bottom end that is attached to the attachment flange and a top end opposite the bottom end, the sleeve body defining a tapered shape along at least a portion of its length such that the top end is wider than the bottom end, wherein:

the sleeve body is configured to:

extend through the opening in the concrete form; and form a tapered channel that is aligned with the opening in a first concrete mixture poured into the concrete form, the tapered channel defining:

a bottom region adjacent to the opening; and a top region opposite the bottom region and wider than the bottom region; and the sleeve system further comprises a tapered plug dimensioned to be positioned in the bottom region of the tapered channel to allow a second concrete mixture to at least partially fill the tapered channel.

11. The sleeve system of claim 10, wherein the tapered plug comprises:

a bottom cap having a first diameter less than or equal to a width of the bottom region of the tapered channel; and a sidewall extending from the bottom cap and defining a tapered shape such that a top portion of the tapered plug has a second diameter greater than the width of the bottom region of the tapered channel.

12. The sleeve system of claim 11, wherein the tapered plug defines a hollow portion around which the sidewall extends.

13. The sleeve system of claim 10, wherein the sleeve body is configured to be broken for removal from the first concrete mixture.

14. The sleeve system of claim 10, wherein a taper angle of the tapered plug matches a taper angle of the tapered channel.

15. The sleeve system of claim 10, wherein the sleeve system further comprises an extension member couplable to the sleeve body at the top end of the sleeve body.

16. A sleeve system comprising:

an attachment flange configured to be attached to a concrete form around an opening in the concrete form; and a sleeve body having a bottom end that is attached to the attachment flange and a top end opposite the bottom end, the sleeve body defining:

a tapered shape along at least a portion of its length such that the top end is wider than the bottom end; and an opening at the top end of the sleeve body, wherein:

the sleeve body is configured to:

extend through the opening in the concrete form; and form a tapered channel that is aligned with the opening in a concrete mixture poured into the concrete form; and the sleeve system further comprises:

a first extension member couplable to the sleeve body and having a first bottom end configured to be received at least partially in the opening at the top end of the sleeve body; and a second extension member couplable to the first extension member and having a second bottom end configured to be received at least partially in an opening at a top end of the first extension member.

* * * * *